US009357316B2

(12) United States Patent
Aerts

(10) Patent No.: US 9,357,316 B2
(45) Date of Patent: May 31, 2016

(54) TIME DIVISION MULTIPLEXED ACCESS METHOD OF OPERATING A NEAR FIELD COMMUNICATION SYSTEM AND A NEAR FIELD COMMUNICATION SYSTEM OPERATING THE SAME

(75) Inventor: Steven Aerts, Louvain (BE)

(73) Assignee: NXP B.V., Eindhoven (NL)

( * ) Notice: Subject to any disclaimer, the term of this patent is extended or adjusted under 35 U.S.C. 154(b) by 737 days.

(21) Appl. No.: 13/310,602

(22) Filed: Dec. 2, 2011

(65) Prior Publication Data

US 2012/0140761 A1 Jun. 7, 2012

(30) Foreign Application Priority Data

Dec. 6, 2010 (EP) ..... 10193830

(51) Int. Cl.
*H04R 25/00* (2006.01)

(52) U.S. Cl.
CPC ..... *H04R 25/554* (2013.01); *H04R 25/552* (2013.01); *H04R 2225/00* (2013.01); *H04R 2225/51* (2013.01); *H04R 2225/55* (2013.01)

(58) Field of Classification Search
None
See application file for complete search history.

(56) References Cited

U.S. PATENT DOCUMENTS 4,942,570 A * 7/1990 Kotzin ..... H04J 4/00 370/263
5,479,522 A * 12/1995 Lindemann ..... H04R 25/356 381/23.1
5,721,783 A * 2/1998 Anderson ..... H04B 1/385 381/312
5,956,330 A * 9/1999 Kerns ..... 370/336
5,982,764 A * 11/1999 Palermo ..... H02J 7/025 370/345
6,009,311 A * 12/1999 Killion ..... H04B 5/06 379/52
6,396,930 B1 * 5/2002 Vaudrey ..... A61B 5/121 381/60
6,728,385 B2 * 4/2004 Kvaløy ..... H04R 1/1016 381/317
7,170,943 B1 1/2007 Van Heeswyk et al.
7,206,426 B1 * 4/2007 Julstrom ..... H04R 25/558 381/315
7,369,671 B2 * 5/2008 Sacha ..... H04R 25/43 381/312
7,452,073 B2 * 11/2008 Jannard ..... G02B 27/0176 351/158
7,512,448 B2 * 3/2009 Malick ..... H04R 25/552 607/136
7,529,565 B2 * 5/2009 Hilpisch ..... H04R 25/554 381/312
7,778,432 B2 * 8/2010 Larsen ..... H04R 25/554 381/314
7,797,022 B2 * 9/2010 Ruzicka ..... H04R 25/558 455/41.2

(Continued)

FOREIGN PATENT DOCUMENTS

DE 10 2008 031581 A1 1/2010
DE 102008031581 * 1/2010 ..... G02C 11/06

(Continued)

OTHER PUBLICATIONS

Gebert et al. ("Hearing aid system, has microphone module that is detachably fastened to glasses frame, includes transceiver provided for radio communication, and wirelessly exchanges data with hearing devices by radio communication" published Jan. 14, 2010) (Machine Translation of German Patent DE102008031581 see Foreign Patent Documents section).*

(Continued)

*Primary Examiner* — Andrew Lai
*Assistant Examiner* — Hoyet H Andrews, III

(57) ABSTRACT

A TDMA method of operating a near-field communication system, in which the same synchronous slot is allocated to more than one, non-interfering, transmitters, is disclosed. The power level may be adjusted to minimize interference from unwanted transmitted signals at respective receivers. A near-field communication system operating such a method is also disclosed.

9 Claims, 2 Drawing Sheets

(56) References Cited

U.S. PATENT DOCUMENTS

| | | | | |
|---|---|---|---|---|
| 8,041,066 | B2 * | 10/2011 | Solum | H04S 1/007 379/430 |
| 8,284,970 | B2 * | 10/2012 | Sacha | H04R 25/43 381/315 |
| 8,340,332 | B2 * | 12/2012 | Nikles | H04R 25/558 381/314 |
| 8,666,314 | B2 * | 3/2014 | Lotter | H04R 25/554 381/23.1 |
| 8,724,835 | B2 * | 5/2014 | Kerselaers | H01Q 7/00 381/315 |
| 9,237,405 | B2 * | 1/2016 | Pinto | H04R 25/55 |
| 2003/0040345 | A1 * | 2/2003 | Berger | H01Q 1/245 455/575.1 |
| 2006/0177081 | A1 * | 8/2006 | Bauml | H04R 25/353 381/315 |
| 2006/0258382 | A1 | 11/2006 | Zhang et al. | |
| 2012/0051278 | A1 * | 3/2012 | Philips | H04H 20/61 370/312 |
| 2012/0314890 | A1 * | 12/2012 | El-Hoiydi | H04R 25/558 381/315 |
| 2013/0129126 | A1 * | 5/2013 | Callias | H02J 7/345 381/315 |

FOREIGN PATENT DOCUMENTS

| | | | | |
|---|---|---|---|---|
| DE | 102008031581 | A1 * | 1/2010 | G02C 11/06 |
| EP | 1 942 702 | A1 | 7/2008 | |
| EP | 2 200 344 | A2 | 6/2010 | |
| NL | EP 2498514 | A1 * | 9/2012 | A61N 1/36032 |
| SG | DE 102008031581 | B4 * | 3/2013 | G02C 11/06 |
| WO | WO 2006023857 | A1 * | 3/2006 | H04R 25/554 |

OTHER PUBLICATIONS

Institute of Electronics and Electrical Engineers Computer Society Part 15.2: Coexistence of Wireless Personal Area Networks with Other Wireless Devices Operating in Unlicensed Frequency Bands pp. 1-15 published Mar. 24, 2003, hereinafter IEEE 802.15.1.*

Gebert et al. ("Hearing aid system, has microphone module that is detachably fastened to glasses frame, includes transceiver provided for radio communication, and wirelessly exchanges data with hearing devices by radio communication" Patent No. DE102008031581 issued on Feb. 24, 1998) Same as Document N.*

TR 36.816 _ Technical Specification Group Radio Access Networks; Evolved Universal Terrestrial Radio Access (E-UTRA); Study on signalling and procedure for interference avoidance for in-device coexistence; (Release 10) published Nov. 2010.*

IEEE Recommended Practice for Information technology—Local and metropolitan area networks—Specific requirements—Part 15.2: Coexistence of Wireless Personal Area Networks with Other Wireless Devices Operating in Unlicensed Frequency Bands, in IEEE Std 802.152-2003 , vol., no., pp. 1-150, Aug. 28, 2003 doi: 10.1109/IEEESTD.2003.94386.*

3GPP TR 36.816 v0.3.0; 3rd Generation Partnership Project;Technical Specification Group Radio Access Networks;Evolved Universal Terrestrial Radio Access (E-UTRA);Study on signalling and procedure for interference avoidance for in-device coexistence;(Release 10), dated Oct. 2010, pp. 1-14.*

Extended European Search Report, 10193830, May 19, 2011.

* cited by examiner

| | RCH1 | SCH1 | RCH2 | SCH2 |
|---|---|---|---|---|
| ER | | 24 | | |
| TR | 21 | 22 | 25 | |
| TL | 23 | | 27 | 26 |
| EL | | | | 28 |

| | RCH1 | SCH1 | RCH2 | SCH2 |
|---|---|---|---|---|
| ER | | 24 | | 24 |
| TR | Tx | 22 | | 22 |
| TL | Rx | 26 | | 26 |
| EL | | 28 | | 28 |

| | RCH1 | SCH1 | SCH2 |
|---|---|---|---|
| ER | | 22 | 42 |
| TR | 21 | 24 | 44 |
| TL | 23 | 26 | 46 |
| EL | | 28 | 48 |

*Fig.4*

TIME DIVISION MULTIPLEXED ACCESS METHOD OF OPERATING A NEAR FIELD COMMUNICATION SYSTEM AND A NEAR FIELD COMMUNICATION SYSTEM OPERATING THE SAME

This application claims the priority under 35 U.S.C. §119 of European patent application no. 10193830.6, filed on Dec. 6, 2010, the contents of which are incorporated by reference herein.

BACKGROUND OF THE INVENTION

For short-range communication, near-field communication techniques are increasingly being used. In comparison with conventional (far-field) radio wireless transmission, in which the intensity of a transmitted electromagnetic signal falls with the square of the distance, in the near field the intensity of the transmitted signal falls with the cube of the distance. Moreover, the interference, attenuation and reflection properties of interposed materials and objects are very different for near-field transmission relative to far-field electromagnetic transmission. For operating frequencies in the megaHertz range, the near-field properties dominant over the range of decimeters (dm) to a few meters (m), so short-range wireless communications such as body area networks operating at these frequencies, are suitable as near-field communication systems. Near-field magnetic induction is known for use in hearing aids, and in particular for retransmission of an audio signal to monophonic or stereophonic hearing aids.

Where a network comprises two or more transmission sources which are in sufficiently close proximity that there can be interference between them, multiplexing methods are required to ensure adequate signal reception. One known such multiplexing method is time division multiplexing access (TDMA). According to the system, difference timeslots within a "frame" are allocated, or scheduled, to different transmitters in the network. Typically, the frame may comprise one or more random channel timeslots, together with two or more synchronous channel timeslots. The random channel timeslots are used for broadcasting control signals such as accommodation signals and notifications as to which transmitter may use individual synchronous channel timeslots. Since these control signals have to be disseminated to all the receivers, they are also termed beacon signals. Random channel slots are available to any transmitter channel, and thus there may be the potential for conflicting concurrent transmission from more than one transmitter. In contrast, during the synchronous channel timeslots, a data signal (such as, for instance, an audio stream) is transmitted only by the nominated transmitter, whilst the other transmitters remain silent so as not to produce interference. Such a time-multiplexed magnetic induction communication system is disclosed in U.S. Pat. No. 5,982,764.

The number of synchronous channel timeslots within any frame is typically fixed, and to ensure that a frame is not overly long, the number of synchronous channel timeslots is limited. It would be desirable if more timeslots could be made available, in order to reliably improve the band-width of the system.

SUMMARY OF THE INVENTION

According to a first aspect of the invention there is provided a method of operating a near-field communication system comprising a first transmitter, a second transmitter and a binaural hearing aid system comprising a left receiver and a right receiver, according to a time division multiplexed access arrangement wherein a time division multiplexed access frame comprises at least a first synchronous channel slot, the method comprising transmitting a left signal from the first transmitter during the first synchronous channel slot, transmitting a right signal from the second transmitter during the first synchronous channel slot, receiving the left signal by the left receiver, and receiving the right signal by the right receiver. Accordingly, the system has an increased bandwidth in comparison with a conventional TDMA arrangement, whilst still benefiting from other advantages of a TDMA arrangement, such as, for instance, the ability to transit control information regarding timbre, dynamic equalisation, noise-cancellation settings and the like to both receivers through random channel or beacon slots. It will be appreciated that where only uncorrelated, non-interfering communication exists, there is no communication across the network, but only independent networks that can co-exist because of spatial re-use. In particular for hearing application, this would be termed a 'bilateral' system, where left and right are not correlated.

A 'true binaural' system uses left-right communication for user control synchronization, such as for instance program or volume control, for adaptive algorithms such as automatically changing the program based on the environment, for synchronized audio dynamics such as Automatic Gain Control (AGC), for audio cross-link, and finally for possible future developments such as noise cancellation and speech enhancement. Such 'true binaural' systems require correlated communication such as TDMA.

In embodiments in accordance with the invention, the time division multiplexed access frame further comprises a random channel slot, and the method further comprising transmitting a control signal from a one of the first and second transmitters during the random channel slot. However, transmission of the control signal need not be in a random channel slot—a synchronous scheduled slot could alternatively be allocated for control information. (It will be appreciated that since only the receiver (or receivers) assigned to the synchronous slot may be assumed to be listening, and the channel throughput is fixed, these slots are less suitable to asynchronous communications. Moreover, since the slot-length of synchronous slots is general uniform, and the control signals are generally carry less content than data signals, this is a less data-efficient, and thus a less preferred, arrangement.)

In embodiments in accordance with the invention, the control signal is transmitted at a higher power level than at least one of the left signal and the right signal. Thus, a method in accordance with the invention may avoid interference between transmitters transmitting on the same timeslot of a TDMA timeframe by means of adjusting the power of the transmitters to ensure that there is no interference. Due to the attenuation of power with the cube of the distance, a relatively small change in the transmission power can correspond to a relatively large change in received power at the receiver. The distance between the two receivers in a binaural hearing aid, during use, is constant may be known with a high degree of accuracy.

According to another aspect of the present invention, there is provided a near field communication system comprising a first transmitter, a second transmitter and a binaural hearing aid system comprising a left receiver and a right receiver and configured to operate according to a time division multiplexed access arrangement wherein a time division multiplexed access frame comprises at least a first synchronous channel slot, the first transmitter being configured to transmit a first data signal during the first synchronous channel slot, and the second transmitter being configured to transmit a second data signal during the first synchronous channel slot.

In embodiments in accordance with the invention, the time division multiplexed access frame further comprises a random channel slot, and a one of the first and second transmitters is configured to transmit a control signal during the random channel slot. In embodiments, the control signal is transmitted at a higher power level than at least one of the first data signals and the second data signals.

In embodiments in accordance with the invention, the first and second transmitters each either comprise a part of or are mounted on a pair of glasses.

The distance between the two receivers in a binaural hearing aid system is constant during use and can be known to a high degree of accuracy.

BRIEF DESCRIPTION OF THE DRAWINGS

Embodiments of the invention will be described, by way of example only, with reference to the drawings, in which

FIG. 4 shows another TDMA framing arrangement according to embodiments of the invention.

Figures 1, 2, 3:
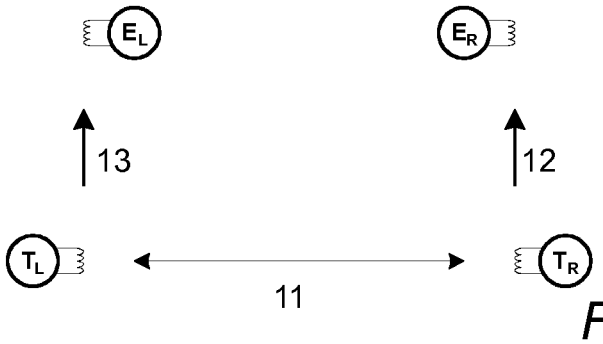
FIG. 1 shows a block diagram of a binaural hearing aid system, which is compatible with embodiments of the invention.
FIG. 2 shows a conventional TDMA framing arrangement.
FIG. 3 shows a TDMA framing arrangement according to embodiments of the invention.

It should be noted that the figures are diagrammatic and not drawn to scale. Relative dimensions and proportions of parts of these Figures have been shown exaggerated or reduced in size, for the sake of clarity and convenience in the drawings. The same reference signs are generally used to refer to corresponding or similar feature in modified and different embodiments

DETAILED DESCRIPTION

FIG. 1 shows a block diagram of a binaural hearing aid system, which is compatible with embodiments of the invention. The figure shows a first transmitter $T_L$ and a second transmitter $T_R$. The two transmitters may be in a fixed arrangement, such as would be the case for instance when the transmitters are built into a pair of glasses. In other arrangements the transmitters may be part of a body area network. For instance they may be built in to clothing or form part of a lanyard multi-transmitter system worn around a user's neck. In the case of glasses-mounted transmitters, the distance between the transmitters may typically be fixed and of the order of 15 cm.

The figure also shows a pair of receivers EL and ER. The receivers may typically be left and right ear buds. In use, the distance between the receivers will generally be fixed since the ear buds are located on or just inside the respective left and right ear of a user, and this distance may be known to a relatively high degree of accuracy.

The distances, and interposing materials, between the various components of the system vary: in particular, between the left and right receivers will typically be a user's skull and brain, whereas between a first transmitter and left receiver may be primarily free space, together with a small amount of body tissue if the receiver is an in-ear bud. The distance between the second transmitter and right receiver may similarly be primarily free space, together with a small amount of body tissue if the receiver is an in-ear bud, whilst the distance and interposing materials between the first and second transmitters will depend significantly on the application. Between each transmitter and the opposite receiver, there will typically also be part of the user's skull and brain, and a greater distance than between the pair of receivers.

In operation, there will be a requirement for communication between the transmitters TL and TR. This communication may be in either direction or both, as indicated by arrow in 11 in FIG. 1. The communication may be for exchanging either data or control information. Generally the communication occurs only occasionally and at very low data rate. Also, there is a requirement for communication from each of the first and second transmitter $T_L$ and $T_R$ to the respective left and right receiver $E_L$ and $E_R$. This communication takes the form of continuous or quasi-continuous audio transmission. Generally, this communication need only be one way, although there may be applications in which the receiver is a transceiver and provides feedback to the relevant transmitter.

FIG. 2 shows a conventional TDMA framing arrangement, such as may be used with the arrangement of FIG. 1 according to conventional methods. The figure shows a TDMA frame having two random channels, RCH1 and RCH2, and two scheduled synchronous channels, SCH1 and SCH2, although other arrangements are possible, for instance all in which the frame has just one random channel RHC and two or more synchronous channels. As shown in FIG. 2, during the first (random channel) timeslot RCH1, there is communication between the two transmitters $T_L$ and $T_R$. The communication may for instance take the form of a transmission TX at 23 from the second, or right, transmitter $T_R$, which transmission is received as a reception RX by the first or left transmitter $T_L$. During the first synchronous slot, SCH1, there is a scheduled data-transmission 22 from the second transmitter $T_R$, which transmission is received at 24 the right receiver $E_R$. Since, for that synchronous timeslot, only the second (right) transmitter is scheduled, the first (left) transmitter is not transmitting. In the next timeslot, there is a random channel slot RCH2, which is available for, for instance, a transmission 25 from the second transmitter $T_R$ to be received at 27 by the first transmitter $T_L$. During the next synchronous slot, SCH2, there is a transmission 26 from the first transmitter $T_L$ which is received at 28 by the left receiver $E_L$.

FIG. 3 shows a TDMA framing arrangement according to embodiments of the invention. This arrangement is also a TDMA arrangement including a beacon or control signal, which is sent in this case during a first random slot RCH1. Similar to the arrangement shown in FIG. 2, further control information may be exchanged in a second random slot RCH2, although in FIG. 3, this slot is shown as empty. Furthermore, the beacon or control information need not be sent during a random channel slot: in other configurations a scheduled synchronous slot may be used for the beacon or control information, provided that no contention occurs during this slot; also, the TDMA timebase may be realised by a broadcast beacon from a single master during the slots RCH, or by a virtual timebase. Again, these various possibilities are true both for prior art arrangement of FIG. 2, and for embodiments of the invention as shown in FIG. 3 (and indeed for other embodiments as shown in later figures).

The inventors have made the unexpected realisation that, even within a TDMA arrangement, synchronous timeslots may be shared, such that two transmitters are operating with the same slot, without loss of the benefits of a TDMA system overall. In particular, owing to the physical separation and relative isolation of the left and right receivers, it is possible for the first (left) transmitter $T_L$ to transmitter to the left receiver $E_L$ at the same time as the second (right) transmitter $T_R$ is transmitting to the right receiver $E_R$.

Such a configurations is shown in the TDMA framing diagram of FIG. 3, where after the first the random channel slot RCH, there is scheduled both a transmission 22 from the second transmitter $T_R$, which transmission is received at 24 the right receiver $E_R$, and a transmission 26 from the first transmitter $T_L$ which is received at 28 by the left receiver $E_L$.

It will be immediately appreciated, that according to such arrangements are there is a much higher utilisation of the transmitters, and thus the overall bandwidth is greater.

FIG. 4 shows another TDMA framing arrangement according to embodiments of the invention. This arrangement is generally similar to that described above with reference to FIG. 3; however, in this case there is no second random channel slot, but rather only a single slot for control or beacon information, which may conveniently be located at the beginning of each frame as shown. By comparison, it will be clear to the reader that the utilisation of the transmitters according to this embodiment is even higher than that according to the embodiment shown of FIG. 3. It will also be immediately apparent that this schema may readily be extended to other framing arrangements, having three or more synchronous scheduled timeslots.

In embodiments of the invention, the signal strength transmitted via one or more of the transmitters may vary in accordance with the slot, viz: when a transmitter is transmitting during a scheduled synchronous slot in which both first and second transmitter are transmitting to respective receivers, the transmitters that may transmitter with a first power level. Conversely, when a transmitter is transmitting beacon or control information during a random channel slot (or, indeed during a scheduled synchronous slot reserved for the purpose), it may transmit with a second respective power level which is higher than the first power. Thereby, the interference received at the respective receivers during the synchronous slots may be significantly reduced.

It will be appreciated that embodiments of the invention may incorporate other measures to minimise or eliminate interference between channels during concurrent synchronous transmission. One such measure is power level negotiation: in the case that the receivers are transceivers and can thus provide feedback of information, the receiver or receivers may measure the received signal strength, and request the transmitter adjust the transmitted energy accordingly. In the above example with a left and a right receiver, the transmitters may each start to transmit at a low novel, and the respective receivers request increased power transmission until the received signal strength from the respective associated transmitter is sufficient to yield a sufficiently low error rate. Due to the increased attenuation at each receiver from the non-associated, opposite transmitter, there will generally be sufficiently low signal strength received from this transmitter to not affect the received signal quality significantly.

Seen from one viewpoint, then, a TDMA method of operating a near-field communication system, in which the same synchronous slot is allocated to more than one, non-interfering, transmitters, is disclosed. The power level may be adjusted to minimise interference from unwanted transmitted signals at respective receivers. A near-field communication system operating such a method is also disclosed.

From reading the present disclosure, other variations and modifications will be apparent to the skilled person. Such variations and modifications may involve equivalent and other features which are already known in the art of magnetic induction communication, and which may be used instead of, or in addition to, features already described herein.

In particular, it should be noted that as used herein, "time division multiplexed access" (TDMA) as used herein is not constrained to any specific TDMA standard, or even to a fixed network TDMA. Rather, the term is to be construed in its general sense to encompass both fixed networks and ad hoc networks. Thus embodiments of the invention further embrace ad hoc networks using dynamic TDMA and slot sharing strategies.

Features which are described in the context of separate embodiments may also be provided in combination in a single embodiment. Conversely, various features which are, for brevity, described in the context of a single embodiment, may also be provided separately or in any suitable sub-combination.

For the sake of completeness it is also stated that the term "comprising" does not exclude other elements or steps, the term "a" or "an" does not exclude a plurality, a single processor or other unit may fulfil the functions of several means recited in the claims and reference signs in the claims shall not be construed as limiting the scope of the claims.

The invention claimed is:

1. A method of operating a near-field communication system comprising a first transmitter, a second transmitter and a binaural hearing aid system comprising a left receiver and a right receiver, according to a time division multiplexed access arrangement wherein a time division multiplexed access frame comprises at least a first synchronous channel slot, wherein a distance between each of the first transmitter and the second transmitter and an opposite receiver is greater than a distance between the left receiver and the right receiver, the method comprising:

transmitting a left signal from the first transmitter during the first synchronous channel slot, transmitting a right signal from the second transmitter during the first synchronous channel slot, receiving the left signal by the left receiver, and receiving the right signal by the right receiver, wherein the time division multiplexed access frame further comprises a random channel slot for concurrent transmission from the first and second transmitters, the method further comprising transmitting a control signal from one of the first and second transmitters during the random channel slot.

2. The method of claim 1, wherein the control signal is transmitted during the random channel slot at a higher power level than at least one of the left signal from the first transmitter and the right signal from the second transmitter.

3. The method of claim 1, comprising measuring a signal strength of one of the left and right signals and requesting the first transmitter or the second transmitter to adjust a transmission energy based on the measured signal strength.

4. The method of claim 1, wherein the first and second transmitters are built into a pair of glasses.

5. A near field communication system comprising a first transmitter, a second transmitter and a binaural hearing aid system comprising a left receiver and a right receiver and configured to operate according to a time division multiplexed access arrangement wherein a time division multiplexed access frame comprises at least a first synchronous channel slot, wherein a distance between each of the first transmitter and the second transmitter and an opposite receiver is greater than a distance between the left receiver and the right receiver, the first transmitter being configured to transmit a first data signal during the first synchronous channel slot, and the second transmitter being configured to transmit a second data signal during the first synchronous channel slot, wherein the time division multiplexed access frame further comprises a random channel slot, and one of the first and second transmitters is configured to transmit a control signal during the random channel slot.

6. The near field communication system according to claim 5, wherein the control signal is transmitted during the random channel slot at a higher power level than at least one of the first data signal from the first transmitter and the second data signal from the second transmitter.

7. The near field communication system according to claim 5, wherein the first and second transmitters each either comprise a part of or are mounted on a pair of glasses.

8. The near field communication system according to claim 5, wherein one of the left and right receivers is configured to measure a signal strength of the left signal or the right signal and requesting the first transmitter or the second transmitter to adjust a transmission energy based on the measured signal strength.

9. The near field communication system according to claim 5, wherein the first and second transmitters are built into a pair of glasses.

* * * * *